US011805922B1

(12) United States Patent
Shen et al.

(10) Patent No.: US 11,805,922 B1
(45) Date of Patent: Nov. 7, 2023

(54) BABY CARE DEVICE

(71) Applicant: Suzhou Lucky Intelligent Technology Co., Ltd., Jiangsu (CN)

(72) Inventors: Zhiwei Shen, Jiangsu (CN); Xueming Zou, Jiangsu (CN); Xueping Lou, Jiangsu (CN)

(73) Assignee: Suzhou Lucky Intelligent Technology Co., Ltd.

( * ) Notice: Subject to any disclaimer, the term of this patent is extended or adjusted under 35 U.S.C. 154(b) by 0 days.

(21) Appl. No.: 18/062,576

(22) Filed: Dec. 7, 2022

(30) Foreign Application Priority Data

Sep. 21, 2022 (CN) ..... 202211148414.X

(51) Int. Cl.
*A47D 13/10* (2006.01)

(52) U.S. Cl.
CPC ..... *A47D 13/10* (2013.01)

(58) Field of Classification Search
CPC .... A47D 13/10; A47D 13/105; A47D 13/101; A47C 3/02; A47C 3/0251; A47C 3/027; A47C 3/026
USPC ..... 297/261.4, 259.1
See application file for complete search history.

(56) References Cited

U.S. PATENT DOCUMENTS

| | | | | |
|---|---|---|---|---|
| 7,958,579 | B2 * | 6/2011 | Westerkamp | A47D 9/016 5/108 |
| 8,047,888 | B1 * | 11/2011 | Seymore | A47D 9/016 472/36 |
| 9,511,300 | B1 * | 12/2016 | Huron | A47D 13/10 |
| 10,702,073 | B2 * | 7/2020 | Paperno | G05D 3/10 |
| 2007/0205646 | A1 * | 9/2007 | Bapst | A47D 9/057 297/261.1 |
| 2017/0143134 | A1 * | 5/2017 | Armbruster | A47D 13/105 |
| 2020/0085196 | A1 * | 3/2020 | DeJule | A47D 9/057 |

FOREIGN PATENT DOCUMENTS

| | | | |
|---|---|---|---|
| CN | 115153260 | A * | 10/2022 |
| KR | 20120045816 | A * | 5/2012 |

* cited by examiner

*Primary Examiner* — Milton Nelson, Jr.

(57) ABSTRACT

A baby care device is disclosed, which comprises a base and a seat holder, wherein the base is connected to a base cover, a plane arc motion mechanism is arranged between the base cover and the base, and an output end of the plane arc motion mechanism is connected to a vertical lifting motion mechanism; a bottom end of the seat holder is connected to an output end of the vertical lifting motion mechanism, and a top end of the seat holder penetrates through the base cover to be connected to a rocking chair frame device; and the plane arc motion mechanism and the vertical lifting motion mechanism work to drive the rocking chair frame device to make three-dimensional combined movements.

10 Claims, 5 Drawing Sheets

BABY CARE DEVICE

CROSS-REFERENCE TO RELATED APPLICATIONS

This application claims priority to Chinese Application No. 202211148414.X, having a filing date of Sep. 21, 2022, the entire contents of which are hereby incorporated by reference.

FIELD OF THE INVENTION

The invention relates to the technical field of baby products, in particular to a baby care device.

BACKGROUND OF THE INVENTION

Baby rocking chairs can bring happiness to children, especially babies, because rocking makes them feel comfortable, and can also help them fall asleep. At present, most baby rocking chairs in the market swing around a fulcrum. For example, Patent No. 2020207599344 discloses a baby rocking chair, which is provided with a pivotable rotating seat and a driving device on an underframe, and the driving device drives the rotating seat to drive a chair body to rotate back and forth along a rotation center line of the rotating seat on the underframe. The baby rocking chair in this patent can only swing around the rotating seat.

A few products can realize two-dimensional combined movements, that is, moving in both a horizontal direction and a vertical direction, but swinging is relatively simple, and the effect of helping children fall asleep is poor. How to design a product that can realize combined movements to make babies fall asleep quickly is a problem to be solved.

SUMMARY OF THE INVENTION

The purpose of the invention is to provide a baby care device to solve the problem in the prior art that baby products cannot make babies fall asleep quickly through three-dimensional combined movements.

In order to achieve the above purpose, the invention adopts the following technical scheme.

A baby care device comprises:

a base, the base being connected to a base cover, a plane arc motion mechanism being arranged between the base cover and the base, and an output end of the plane arc motion mechanism being connected to a vertical lifting motion mechanism; and a seat holder, a bottom end of the seat holder being connected to an output end of the vertical lifting motion mechanism, and a top end of the seat holder penetrating through the base cover to be connected to a rocking chair frame device;

wherein the plane arc motion mechanism and the vertical lifting motion mechanism work to drive the rocking chair frame device to make three-dimensional combined movements.

Further, the plane arc motion mechanism comprises a first driving component and a movable stand, the movable stand is slidably connected to the base, and the first driving component is connected to the movable stand to make the movable stand reciprocate in an arc form.

Further, the first driving component comprises a motor component connected to the base and a first large pulley rotationally arranged on the base;

a first small pulley connected to an output end of the motor component is connected to the first large pulley through a first belt, and the first large pulley is rotationally connected to an end of the movable stand through an eccentric shaft.

Further, an end, away from the eccentric shaft, of a bottom of the movable stand is provided with a cylindrical boss, the base is provided with a base slot, and the cylindrical boss is slidably connected in the base slot.

Further, a bottom surface of the movable stand has an end provided with a universal wheel and an end provided with a moving wheel.

Further, the vertical lifting motion mechanism comprises a lifting support seat connected to the movable stand, and a lifting sliding seat is slidably connected to an inside of the lifting support seat;

a bottom end of the seat holder is connected to the lifting sliding seat.

Further, the vertical lifting motion mechanism further comprises a screw rod and a lifting driving motor component connected to the movable stand, a bottom end of the screw rod penetrates through the movable stand to be fixedly connected to a second pulley, a screw nut is screwed to the screw rod above the movable stand, and the screw nut is connected to the lifting sliding seat;

a pulley at an output end of the lifting driving motor component is connected to the second pulley through a second belt.

Further, at least two guide posts are arranged in the lifting support seat, and the lifting sliding seat is slidably connected to the guide posts.

Further, a moving baffle for sealing the base cover is further connected to a top end of the lifting support seat.

Further, the rocking chair frame device comprises a rocking chair support connected to a top of the seat holder, seat joints are connected to two ends of a top of the rocking chair support respectively, one side of the two seat joints is connected to a seat rod, and the other side of the two seat joints is connected to a backrest rod;

a rocking tube is connected to a bottom of the rocking chair support.

According to the above technical scheme, the embodiment of the invention has at least the following effect: the plane arc motion mechanism and the vertical lifting motion mechanism located at the output end of the plane arc motion mechanism are arranged between the base and the base cover, and the rocking chair frame device at the output end of the vertical lifting motion mechanism is driven to make three-dimensional combined movements under the combined action of the plane arc motion mechanism and the vertical lifting motion mechanism, so that the rocking chair frame making three-dimensional combined movements can make babies fall asleep quickly.

Figure 1:
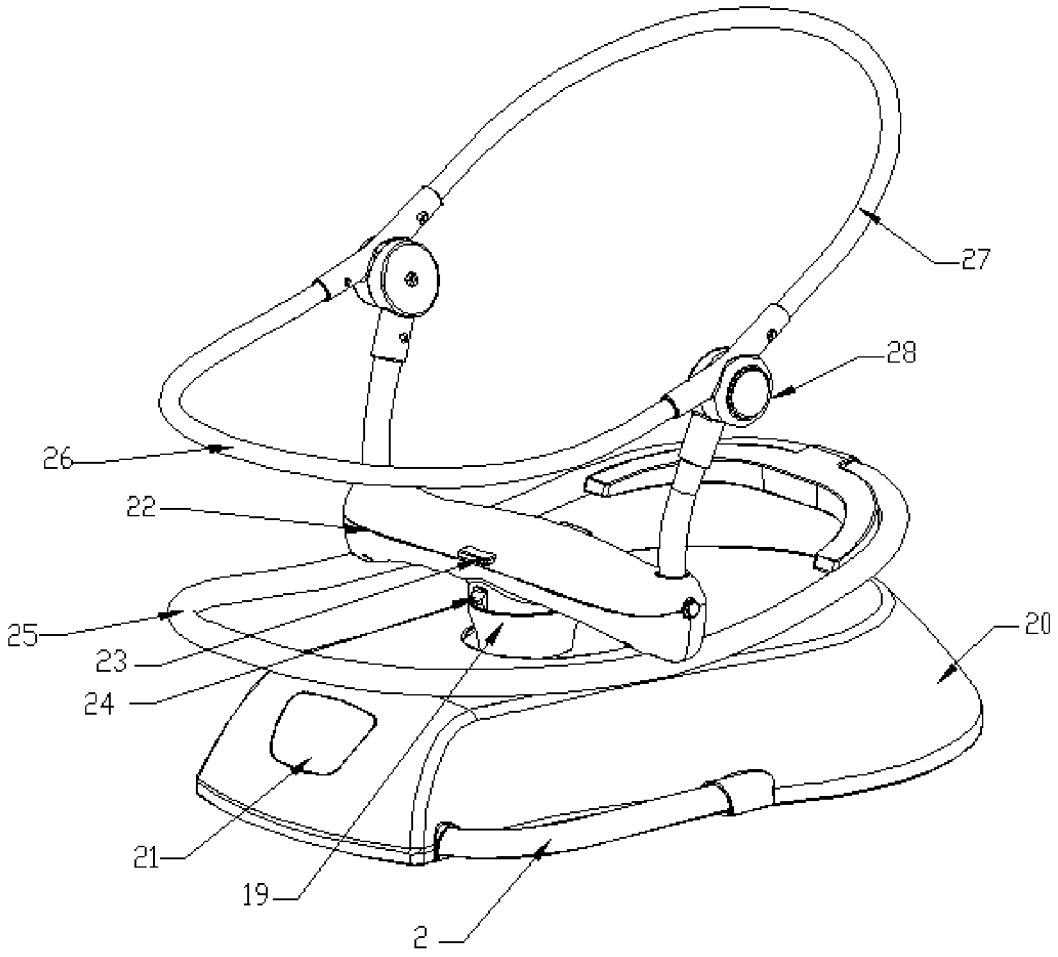
FIG. 1 is a diagram of an overall structure of the invention.
Figure 2:
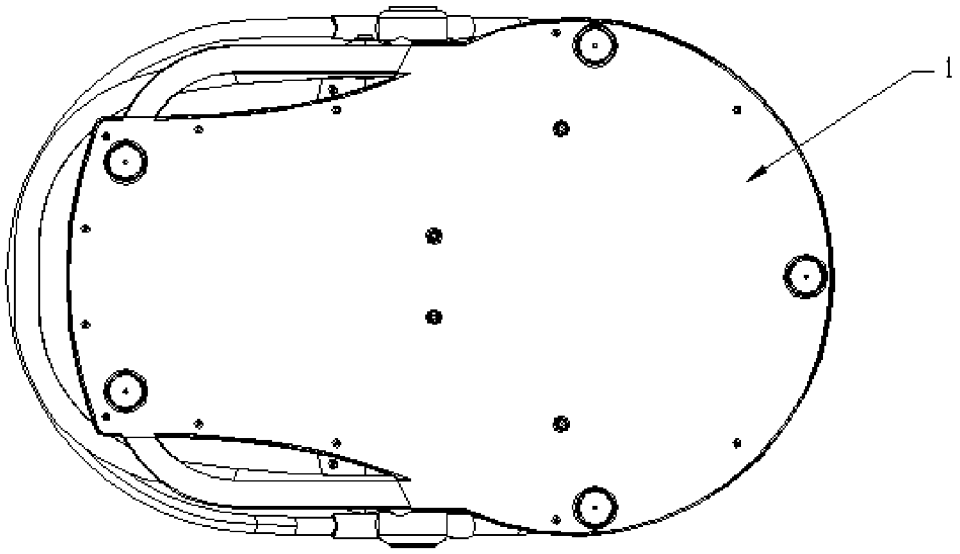
FIG. 2 is a bottom view of the invention.

1, base; 2, base handle; 3, motor component; 4, first small pulley; 5, first belt; 6, first large pulley; 7, movable stand; 8, universal wheel; 9, moving wheel; 10, lifting driving motor component; 11, second belt; 12, second pulley; 13, screw rod; 14, screw nut; 15, lifting sliding seat; 15-1, induction boss; 16, lifting support seat; 17, guide post; 18, moving baffle; 19, seat holder; 20, base cover; 21, control panel; 22, rocking chair support; 23, quick-folding button; 24, rocking chair rotation locking button; 25, rocking tube; 26, seat rod; 27, backrest rod; 28, seat joint; 29, cylindrical boss; 30, sensor; 31, infrared sensor.

DETAILED DESCRIPTION OF THE INVENTION

In order to make the technical means, creative features, goals and effects of the invention easy to understand, the invention will be further explained below with specific embodiments.

It should be noted that in the description of the invention, the directional or positional relationships indicated by the terms "front", "back", "left", "right", "upper", "lower", "inside" and "outside" are based on the directional or positional relationships shown in the drawings, which are only for the convenience of describing the invention and do not require that the invention must be constructed and operated in a specific direction, so they should not be construed as a limitation of the invention. The terms "front", "back", "left", "right", "upper" and "lower" used in the description of the invention refer to the directions in the drawings, and the terms "inside" and "outside"refer to the directions towards or away from the geometric center of a specific part respectively.

Based on the fact that car rides tend to make people sleepy, whether adults or children, the application discloses a baby care product, which can realize three-dimensional movements. Specifically, the baby care product can move in a plane arc form, move vertically, and simulate the turning and bumping of a car, so as to produce a feeling of sitting in a moving car, thus helping babies fall asleep quickly.

As shown in FIGS. 1-7, the invention discloses a baby care device, which comprises a base 1 and a seat holder 19, wherein the base 1 is connected to a base cover 20, a plane arc motion mechanism is arranged between the base cover 20 and the base 1, and an output end of the plane arc motion mechanism is connected to a vertical lifting motion mechanism; a bottom end of the seat holder 19 is connected to an output end of the vertical lifting motion mechanism, and a top end of the seat holder 19 penetrates through the base cover 20 to be connected to a rocking chair frame device; and the plane arc motion mechanism and the vertical lifting motion mechanism work to drive the rocking chair frame device to make three-dimensional combined movements.

According to the invention, the rocking chair frame device at the output end of the vertical lifting motion mechanism is driven to make three-dimensional combined movements under the combined action of the plane arc motion mechanism and the vertical lifting motion mechanism, so that the rocking chair frame making three-dimensional combined movements can make babies fall asleep quickly.

According to the baby care device in the invention, the plane arc motion mechanism can reciprocate in an arc form. Specifically, the plane arc motion mechanism comprises a first driving component and a movable stand 7, the movable stand 7 is slidably connected to the base 1, and the first driving component is connected to the movable stand 7 to make the movable stand 7 reciprocate in an arc form.

In order to make the movable stand 7 reciprocate in an arc form on the base 1, the first driving component adopts the design of an eccentric wheel. Specifically, the first driving component comprises a motor component 3 connected to the base 1 and a first large pulley 6 rotationally arranged on the base 1; and a first small pulley 4 connected to an output end of the motor component 3 is connected to the first large pulley 6 through a first belt 5. An eccentric shaft is connected to a non-center position of the first large pulley 6, and the first large pulley is rotationally connected to a right end of the movable stand 7 through the eccentric shaft.

Figure 6:
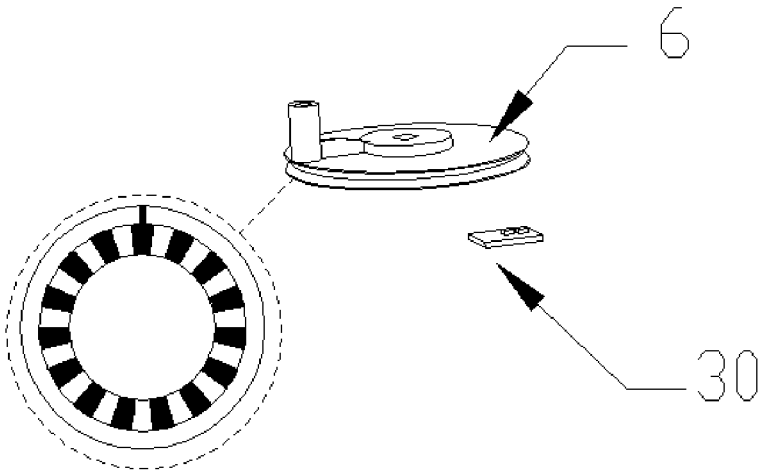
FIG. 6 shows a first large pulley and an enlarged view thereof.
Figure 7:
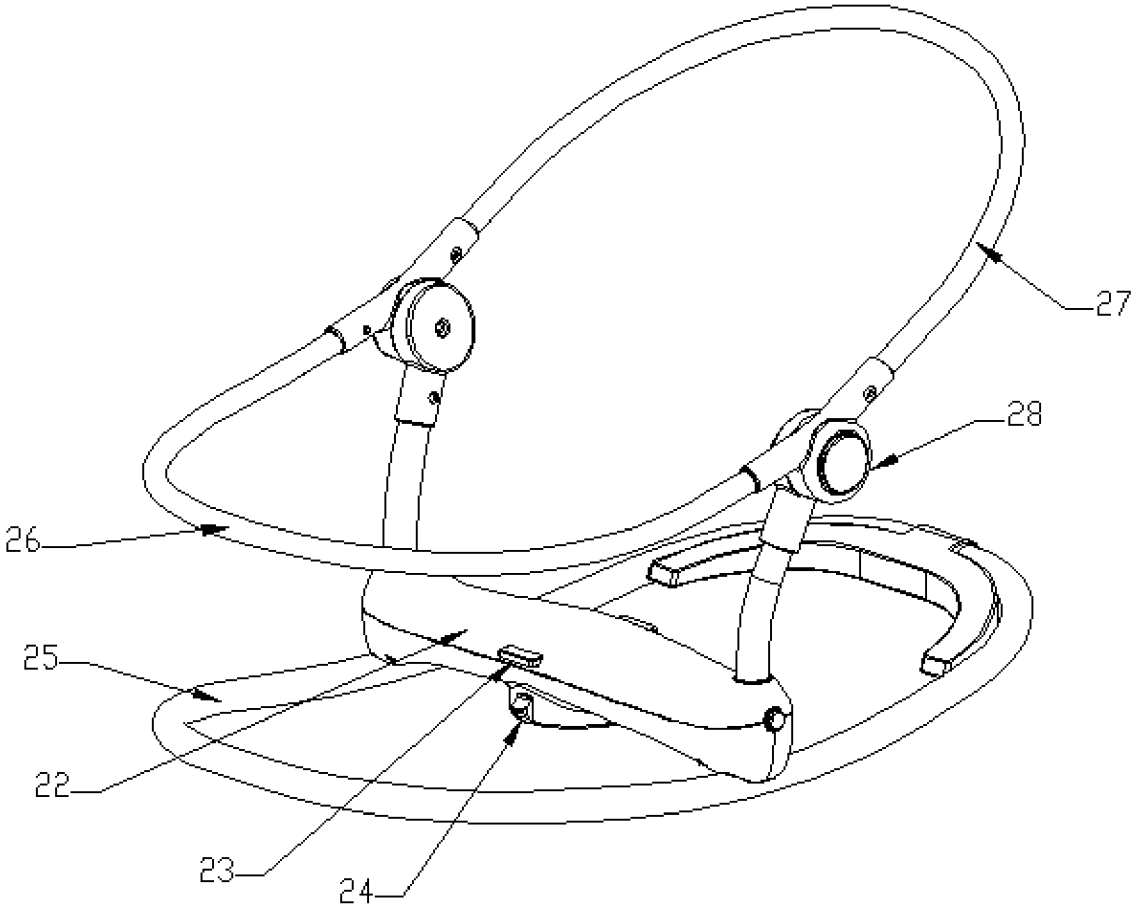
FIG. 7 is a structural diagram of a rocking chair frame device of the invention.

As shown in FIG. 6, the following control component is also provided. A reflective grid in black and white is silk-printed on a back surface (one side near the base 1) of the first large pulley 6, an inductor 30 is arranged on the base 1 below the first large pulley 6, which can detect the reflective grid, and the inductor 30 detects the grid to identify the rotational speed and relative position of pulleys, so as to accurately control the track of the movable stand 7. By providing the control component, the movable stand 7 can controlled precisely and intelligently.

In some further embodiments, a bottom of a left end of the movable stand 7 is provided with a cylindrical boss 29, which is slidably connected to a base slot and can rotate relative to the base slot, so that the movable stand 7 reciprocates in an elliptical arc form on the base 1.

During working, the motor component 3 works to drive the first large pulley 6 to rotate through the first small pulley 4 and the first belt 5. The first large pulley 6 rotates to drive the eccentric shaft connected thereto to make a circular motion around the center of the first large pulley 6. As the eccentric shaft is connected to the right end of the movable stand 7, the rotation of the first large pulley 6 can drive the movable stand 7 to reciprocate in an arc form.

In a further embodiment of this application, in order to ensure the moving effect of the movable stand 7, a universal wheel 8 and a moving wheel 9 are arranged on a bottom surface of the movable stand 7, the universal wheel 8 is arranged at a right end of the bottom surface of the movable stand 7, and the moving wheel 9 is arranged at a left end of the bottom surface of the movable stand. Through the arrangement of the moving wheel 9 and the universal wheel 8, the stability and convenience of the movable stand 7 can be ensured.

In a further embodiment of the application, the vertical lifting motion mechanism comprises a lifting support seat 16 connected to the movable stand 7, and a lifting sliding seat 15 is slidably connected to the inside of the lifting support seat 16. A bottom end of the seat holder 19 is connected to the lifting sliding seat 15. In operation, the seat holder 19 is driven to move up and down by the ascending and descending of the lifting sliding seat 15.

Further, in order to ensure the three-dimensional combined movements between the base 1 and the base cover 20, the application adopts an eccentric motion mechanism and a screw nut mechanism, that is, the ascending and descending of the lifting sliding seat 15 are realized through the screw nut mechanism.

In a specific embodiment, the vertical lifting motion mechanism further comprises a screw 13 and a lifting driving motor component 10 connected to the movable stand 7. A bottom end of the screw 13 penetrates through the movable stand 7 to be fixedly connected to a central shaft hole of the second pulley 12. A screw nut 14 is screwed to the periphery of the screw 13 above the movable stand 7, and the screw nut 14 is fixedly connected to the lifting sliding seat 15.

A pulley at an output end of the lifting driving motor component 10 is connected to the second pulley 12 through a second belt 11. During operation, the lifting driving motor component 10 works to drive the second pulley 12 to rotate, the screw 13 in the second pulley 12 rotates, and the screw nut 14 connected to the screw 13 moves up and down to drive the lifting sliding seat 15 up and down.

Figure 3:
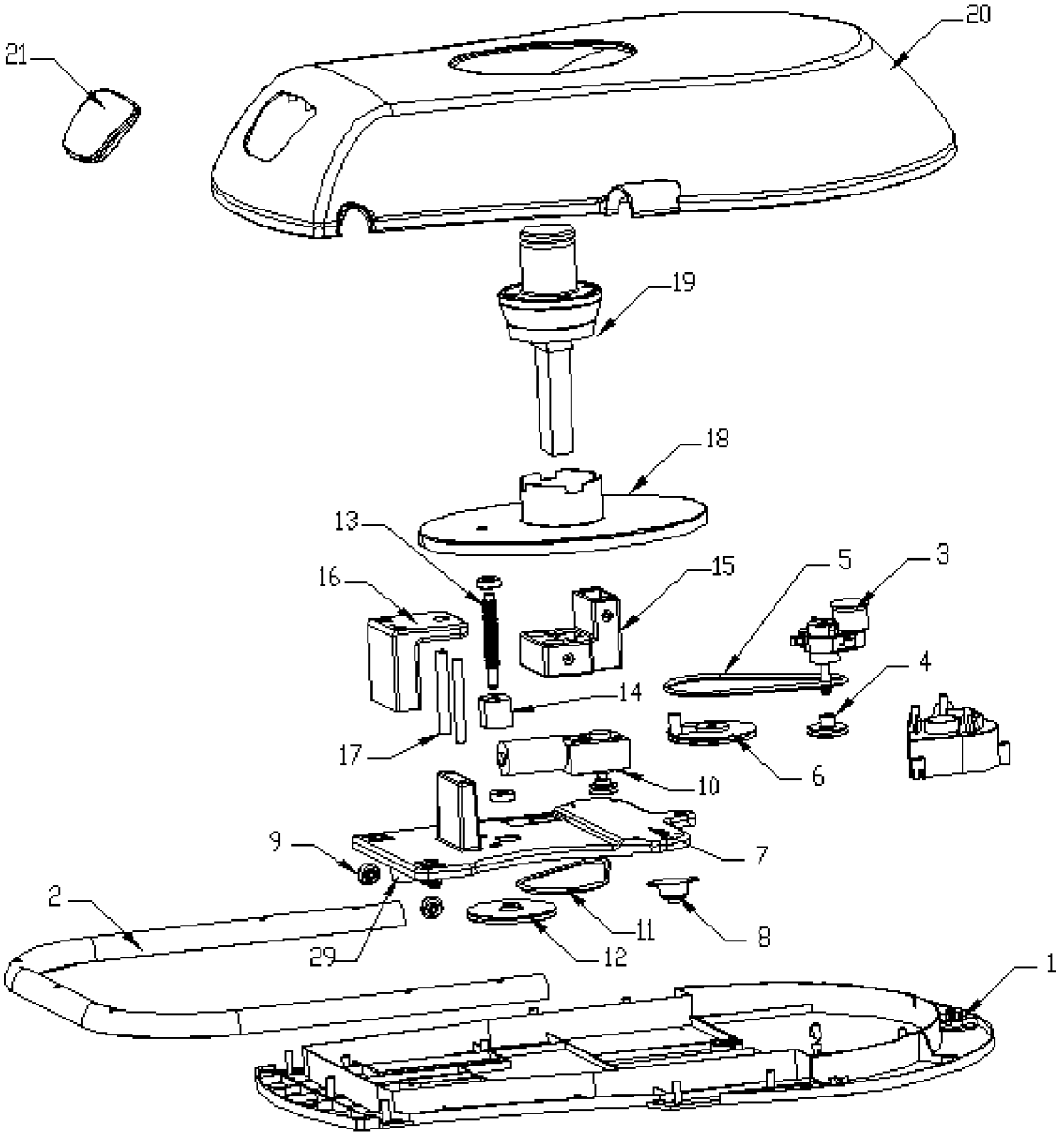
FIG. 3 is an exploded view of the invention.
Figure 4:
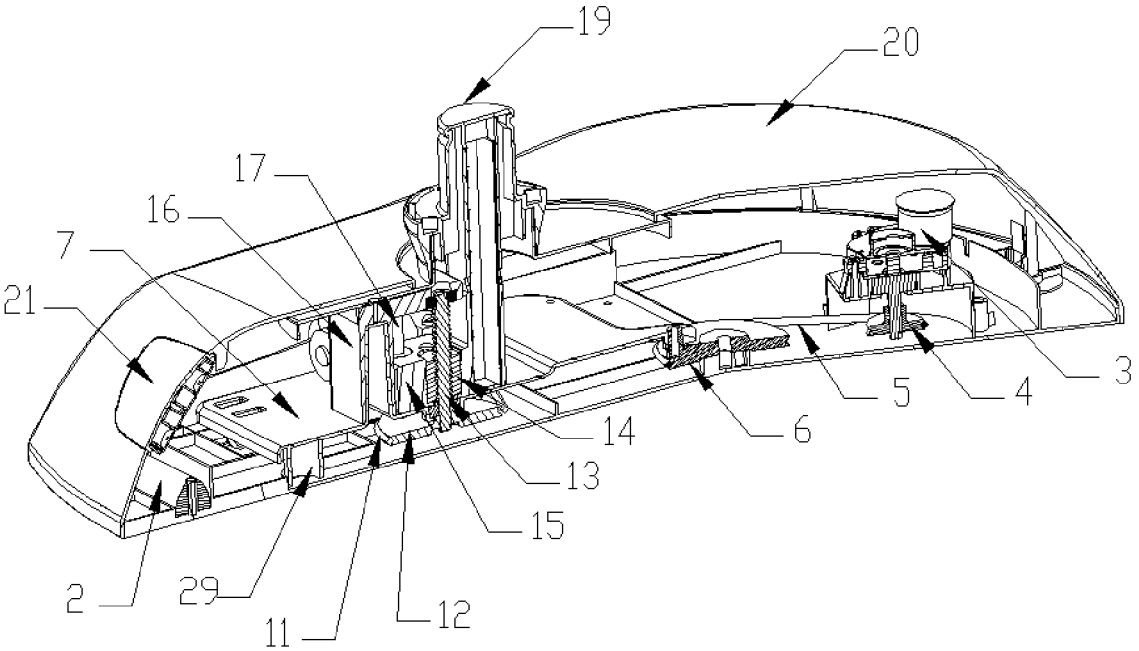
FIG. 4 is a sectional view of a partial structure in FIG. 1.

Further, as shown in FIG. 3, the movable stand 7 is provided with a convex connecting base, the lifting support seat 16 is roughly L-shaped, the convex connecting base is sleeved with a hollow vertical part of the lifting support seat, and the two are fixed by a screw.

In some further embodiments, in order to ensure the lifting and sliding effect of the lifting sliding seat 15, two guide posts 17 are further arranged in the lifting support seat 16, top ends of the guide posts 17 are connected to a horizontal part of the lifting support seat 16, and bottom ends of the guide posts 17 are inserted into holes of the movable stand 7. The lifting sliding seat 15 is provided with through holes, and the guide posts 17 are slidably connected to the through holes.

Figure 5:
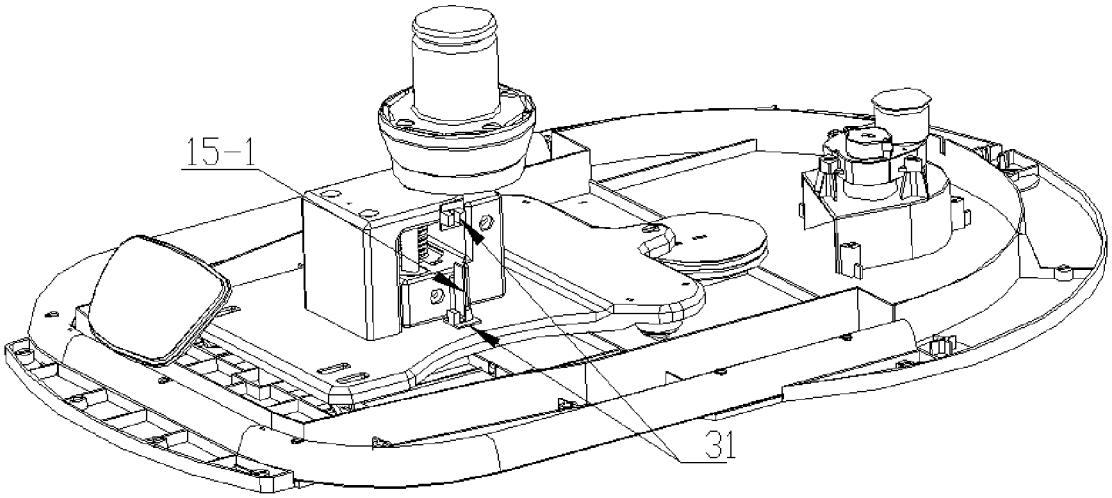
FIG. 5 is a diagram of the installation of a movable stand.

As shown in FIG. 5, the following control component is also provided. An induction boss 15-1 is arranged on a side face of the lifting sliding seat 15, an infrared sensor 31 is arranged on a side face of the horizontal part of the lifting support seat 16, and an infrared sensor 31 is further arranged on the movable stand 7. The two infrared sensors 31 are respectively located on upper and lower sides of the lifting sliding seat 15. When the lifting sliding seat moves upward, the induction boss 15-1 moves to contact with the upper infrared sensor 31. The upper infrared sensor 31 transmits a signal to the lifting driving motor component 10 to control the lifting driving motor component 10 to rotate reversely, so as to control the screw rod to rotate reversely, thus realizing the downward movement of the lifting sliding seat 15. When the induction boss 15 on the lifting sliding seat 15 moves to contact with the lower infrared sensor 31, the lower infrared sensor 31 transmits a signal to the lifting driving motor component 10 to control the lifting driving motor component 10 to rotate reversely, thus realizing the upward movement of the lifting sliding seat 15. This arrangement ensures that the lifting sliding seat 15 can automatically change the direction after moving to upper and lower limit positions.

In some further embodiments, a moving baffle 18 is further connected to a top end of the lifting support seat 16 by screws, and the size of the moving baffle 18 is greater than that of a hole on the base cover 20. When the plane arc motion mechanism drives the lifting support seat 16 to reciprocate in an elliptical arc form, the moving baffle 18 can still block the hole on the base cover 20, so as to ensure the sealing effect.

In some embodiments, the rocking chair frame device comprises a rocking chair support 22 connected to a top of the seat holder 19, seat joints 28 are connected to two ends of a top of the rocking chair support 22 respectively, one side of the two seat joints 28 is connected to a seat rod 26, and the other side of the two seat joints is connected to a backrest rod 27. A rocking tube 25 is connected to a bottom of the rocking chair support 22.

When the whole rocking chair frame device is detached from the seat holder 19, the rocking tube 25 generates a supporting effect, so that the rocking chair frame device can be placed on the ground through the rocking tube 25. The seat rod 26 and the backrest rod 27 can protect and support a baby.

In some further embodiments, the base cover 20 is further provided with a control panel 21, which is connected to an internal controller or PCB, and the controller or PCB is used to control the movements of the lifting driving motor component 10 and the motor component 3, so as to realize the three-dimensional combined movements of the device.

In some further embodiments, a quick-folding button 23 and a rocking chair rotation locking button 24 are also provided. The quick-folding button 23 is used for folding the rocking chair frame device, and the rocking chair rotation locking button 24 is used for locking the rocking chair frame device to prevent it from rotating. The functions of the quick-folding button 23 and the rocking chair rotation locking button 24 can be realized by mechanisms in the prior art.

In some further embodiments, the base 1 is further provided with a base handle 2, through which the whole device can be lifted.

According to common technical knowledge, the invention can be realized by other embodiments without departing from its spirit or essential characteristics. Therefore, the above-mentioned embodiments, in all respects, are merely exemplary, instead of being exhaustive. All changes within the scope of the invention or within the scope equivalent to the invention are encompassed by the invention.

The invention claimed is:

1. A baby care device, comprising: a base (1), the base (1) being connected to a base cover (20), a plane arc motion mechanism being arranged between the base cover (20) and the base (1), and an output end of the plane arc motion mechanism being connected to a vertical lifting motion mechanism; and a seat holder (19), a bottom end of the seat holder (19) being connected to an output end of the vertical lifting motion mechanism, and a top end of the seat holder (19) penetrating through the base cover (20) to be connected to a rocking chair frame device;

wherein the plane arc motion mechanism and the vertical lifting motion mechanism work to drive the rocking chair frame device to make three-dimensional combined movements.

2. The baby care device according to claim 1, wherein the plane arc motion mechanism comprises a first driving component and a movable stand (7), the movable stand (7) is slidably connected to the base (1), and the first driving component is connected to the movable stand (7) to make the movable stand (7) reciprocate in an arc form.

3. The baby care device according to claim 2, wherein the first driving component comprises a motor component (3) connected to the base (1) and a first large pulley (6) rotationally arranged on the base (1);

a first small pulley (4) connected to an output end of the motor component (3) is connected to the first large pulley (6) through a first belt (5), and the first large pulley (6) is rotationally connected to an end of the movable stand (7) through an eccentric shaft.

4. The baby care device according to claim 3, wherein an end, away from the eccentric shaft, of a bottom of the movable stand (7) is provided with a cylindrical boss (29), the base (1) is provided with a base slot, and the cylindrical boss (29) is slidably connected in the base slot.

5. The baby care device according to claim 2, wherein a bottom surface of the movable stand (7) has an end provided with a universal wheel (8) and an end provided with a moving wheel (9).

6. The baby care device according to claim 2, wherein the vertical lifting motion mechanism comprises a lifting support seat (16) connected to the movable stand (7), and a lifting sliding seat (15) is slidably connected to an inside of the lifting support seat (16);

a bottom end of the seat holder (19) is connected to the lifting sliding seat (15).

7. The baby care device according to claim 6, wherein the vertical lifting motion mechanism further comprises a screw rod (13) and a lifting driving motor component (10) connected to the movable stand (7), a bottom end of the screw rod (13) penetrates through the movable stand (7) to be fixedly connected to a second pulley (12), a screw nut (14) is screwed to the screw rod (13) above the movable stand (7), and the screw nut (14) is connected to the lifting sliding seat (15);

a pulley at an output end of the lifting driving motor component (10) is connected to the second pulley (12) through a second belt (11).

8. The baby care device according to claim 6, wherein at least two guide posts (17) are arranged in the lifting support seat (16), and the lifting sliding seat (15) is slidably connected to the guide posts (17).

9. The baby care device according to claim 6, wherein a moving baffle (18) for sealing the base cover (20) is further connected to a top end of the lifting support seat (16).

10. The baby care device according to claim 1, wherein the rocking chair frame device comprises a rocking chair support (22) connected to a top of the seat holder (19), seat joints (28) are connected to two ends of a top of the rocking chair support (22) respectively, and the two seat joints (28) have a side connected to a seat rod (26) and a side connected to a backrest rod (27);

a rocking tube (25) is connected to a bottom of the rocking chair support (22).

* * * * *